US009855476B2

(12) United States Patent
Seluga et al.

(10) Patent No.: US 9,855,476 B2
(45) **Date of Patent: *Jan. 2, 2018**

(54) GOLF CLUB HEAD WITH STRUCTURAL COLUMNS

(71) Applicant: Callaway Golf Company, Carlsbad, CA (US)

(72) Inventors: James A. Seluga, Carlsbad, CA (US); Matthew Myers, Carlsbad, CA (US); Irina Ivanova, San Diego, CA (US); Bradley C. Rice, Carlsbad, CA (US); William C. Watson, Temecula, CA (US); Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/628,100

(22) Filed: Jun. 20, 2017

(65) Prior Publication Data

US 2017/0282022 A1 Oct. 5, 2017

Related U.S. Application Data

(63) Continuation of application No. 15/447,638, filed on Mar. 2, 2017, now Pat. No. 9,687,702, which is a continuation-in-part of application No. 15/279,188, filed on Sep. 28, 2016, now Pat. No. 9,687,701, which is a continuation of application No. 14/847,227, filed on Sep. 8, 2015, now Pat. No. 9,486,677, which is a continuation-in-part of application No. 14/285,479, (Continued)

(51) Int. Cl.
*A63B 53/04* (2015.01)
*A63B 53/06* (2015.01)

(52) U.S. Cl.
CPC .... *A63B 53/0466* (2013.01); *A63B 2053/045* (2013.01); *A63B 2053/0408* (2013.01); *A63B 2053/0412* (2013.01); *A63B 2053/0433* (2013.01); *A63B 2053/0437* (2013.01)

(58) Field of Classification Search
CPC ..... A63B 53/0466; A63B 2053/045; A63B 2053/0408; A63B 2053/0412; A63B 2053/0433; A63B 2053/0437
USPC ..... 473/324–350, 287–292
See application file for complete search history.

(56) References Cited

U.S. PATENT DOCUMENTS 8,257,195 B1 * 9/2012 Erickson ..... A63B 53/0466 473/329
8,328,661 B1 * 12/2012 Erickson ..... A63B 53/0466 473/329

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having multiple structural columns is disclosed herein. A body comprises a face section, a sole section, and a crown or return section, and defines a hollow interior. Each of the structural columns extends from the crown or return section to the sole section within the hollow interior to reduce stresses placed on the face section during impact with a golf ball. The structural columns are all located within 1 inch of a rear surface of the face section measured along a plane normal to the center of the face, and are spaced a distance of 0.500 to 2.00 inch from one another within the hollow interior.

20 Claims, 17 Drawing Sheets

Related U.S. Application Data filed on May 22, 2014, now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, now Pat. No. 9,814,947, and a continuation-in-part of application No. 14/788,326, filed on Jun. 30, 2015, now Pat. No. 9,597,558, said application No. 14/794,578 is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/898,956, filed on Nov. 1, 2013, provisional application No. 61/665,203, filed on Jun. 27, 2012, provisional application No. 61/684,079, filed on Aug. 16, 2012.

(56) References Cited

U.S. PATENT DOCUMENTS 8,414,420 B1 * 4/2013 Erickson ..... A63B 53/0466 473/329
8,425,346 B1 * 4/2013 Erickson ..... A63B 53/0466 473/329
8,690,708 B1 * 4/2014 Ehlers ..... A63B 53/0466 473/337
8,834,294 B1 * 9/2014 Seluga ..... A63B 53/04 473/338
8,835,294 B2 * 9/2014 Chew ..... H01L 21/02697 257/330
8,900,070 B1 * 12/2014 Dawson ..... A63B 53/047 473/329
8,926,448 B1 * 1/2015 Ivanova ..... A63B 53/047 473/329
8,956,244 B1 * 2/2015 Westrum ..... A63B 53/04 473/338
9,022,881 B1 * 5/2015 Ehlers ..... A63B 53/06 473/335
9,067,110 B1 * 6/2015 Seluga ..... A63B 53/06
9,072,951 B1 * 7/2015 Tang ..... A63B 53/06
9,101,811 B1 * 8/2015 Goudarzi ..... A63B 53/0466
9,180,349 B1 * 11/2015 Seluga ..... A63B 53/04
9,211,451 B1 * 12/2015 Westrum ..... A63B 53/047
9,211,453 B1 * 12/2015 Foster ..... A63B 53/06
9,216,332 B1 * 12/2015 Ehlers ..... A63B 53/06
9,259,627 B1 * 2/2016 Myers ..... A63B 53/04
9,333,390 B1 * 5/2016 Manwaring ..... A63B 24/0003
9,345,936 B1 * 5/2016 Westrum ..... A63B 53/04
9,352,199 B2 * 5/2016 Seluga ..... A63B 53/06
9,409,069 B2 * 8/2016 Ehlers ..... A63B 53/06
9,463,361 B2 * 10/2016 Goudarzi ..... A63B 53/0466
9,486,677 B1 * 11/2016 Seluga ..... A63B 53/0466
9,586,105 B1 * 3/2017 Westrum ..... A63B 53/047
9,597,558 B1 * 3/2017 Seluga ..... A63B 53/0466
9,597,561 B1 * 3/2017 Seluga ..... A63B 53/0466
9,623,302 B1 * 4/2017 Myers ..... A63B 53/06
9,687,701 B1 * 6/2017 Seluga ..... A63B 53/0466
9,687,702 B1 * 6/2017 Seluga ..... A63B 53/0466
9,694,257 B1 * 7/2017 Seluga ..... A63B 53/0466
9,757,629 B2 * 9/2017 Seluga ..... A63B 53/0466
9,776,058 B2 * 10/2017 Seluga ..... A63B 53/0466

* cited by examiner

GOLF CLUB HEAD WITH STRUCTURAL COLUMNS

CROSS REFERENCES TO RELATED APPLICATIONS

The present application is a continuation of U.S. patent application Ser. No. 15/447,638, filed on Mar. 2, 2017, and issued on Jun. 27, 2017, as U.S. Pat. No. 9,687,702, which is a continuation-in-part application of U.S. patent application Ser. No. 15/279,188 filed on Sep. 28, 2016, and issued on Jun. 27, 2017, as U.S. Pat. No. 9,687,701, which is a continuation application of U.S. patent application Ser. No. 14/847,227 filed on Sep. 8, 2015, and issued on Nov. 8, 2016, as U.S. Pat. No. 9,486,677, which is a continuation-in-part application of U.S. patent application Ser. No. 14/285,479 filed on May 22, 2014, and issued on Dec. 15, 2015, as U.S. Pat. No. 9,211,451, which is a continuation-in-part application of U.S. patent application Ser. No. 13/788,173 filed on Mar. 7, 2013, and issued on Jan. 6, 2015, as U.S. Pat. No. 8,926,448, and also is a continuation-in-part application of U.S. patent application Ser. No. 14/788,326 filed on Jun. 30, 2015, and issued on Mar. 21, 2017, as U.S. Pat. No. 9,597,558, and also is a continuation-in-part application of U.S. patent application Ser. No. 14/794,578 filed on Jul. 8, 2015, and issued on Nov. 14, 2017, as U.S. Pat. No. 9,814,947, which is a continuation-in-part of U.S. patent application Ser. No. 14/755,068, filed on Jun. 30, 2015, and issued on Apr. 18, 2017, as U.S. Pat. No. 9,623,302, which is a continuation-in-part application of U.S. patent application Ser. No. 14/498,843 filed on Sep. 26, 2014, and issued on Feb. 16, 2016, as U.S. Pat. No. 9,259,627, which is a continuation-in-part application of U.S. patent application Ser. No. 14/173,615 filed on Feb. 5, 2014, and issued on Nov. 10, 2015, as U.S. Pat. No. 9,180,349, which claims priority to U.S. Provisional Patent Application No. 61/898,956 filed on Nov. 1, 2013, and which is a continuation-in-part application of U.S. patent application Ser. No. 14/039,102 filed on Sep. 27, 2013, and issued on Sep. 16, 2014, as U.S. Pat. No. 8,834,294, which is a continuation application of U.S. patent application Ser. No. 13/797,404 filed on Mar. 12, 2013, now abandoned, which claims priority to U.S. Provisional Patent Application No. 61/665,203 filed on Jun. 27, 2012, and 61/684,079 filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing features connecting a crown portion with a sole portion via a hollow interior and disposed proximate a striking face section.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head comprises interior structures connecting a crown section to a sole section to reduce the stress in a striking face section during impact with a golf ball. In some embodiments, the interior structures are hollow tubes or solid rods composed of a titanium alloy.

One aspect of the present invention is a golf club head comprising a cast metal body. The cast metal body comprises a toe structural connector, a heel structural connector, a striking face section, a crown return portion and a sole section. The toe structural connector comprises a body with a crown end, a sole end, a forward surface, a rearward surface, a heel surface and a toe surface. The heel structural connector comprises a body with a crown end, a sole end, a forward surface, a rearward surface, a heel surface and a toe surface. The striking face section has an exterior surface, an interior surface, an upper perimeter and a lower perimeter. The crown return portion extends rearward from the upper perimeter of the striking face section. The sole section portion extends rearward from the lower perimeter of the striking face section. The crown end of the toe structural connector is connected to the crown return portion. The crown end of the heel structural connector is connected to the crown return portion. The sole end of the toe structural connector is connected to the sole section. The sole end of the heel structural connector is connected to the sole section. A contact surface area between the crown return portion and both of the crown end of the toe structural connector and the crown end of the heel structural connector ranges from 1% to 5% of the surface area of the crown return portion. The toe structural connector and the heel structural connector attenuate movement of the crown return portion and the sole section when the striking face section impacts a golf ball.

In some embodiments, each of the structural connectors comprises a structure selected from the group consisting of a solid rod and a hollow tube. In another, further embodiment, each of the structural connectors is a solid rod composed of a metal material selected from the group consisting of titanium alloy and steel. In an alternative embodiment, each of the structural connectors is located no more than 0.25 inch from the rear face surface along the vertical plane extending through the face center perpendicular to the striking face section.

Another aspect of the current invention is golf club head comprising a metal body comprising a striking face section, a sole section extending from a lower edge of the striking face section, and a return section extending from an upper edge of the striking face section, the return section and sole section defining an upper opening, and the striking face section, sole section, and return section defining a hollow body interior, and first and second structural connectors disposed within the hollow body interior and extending from the return section to the sole section, wherein each of the first and second structural connectors is a solid metal rod, wherein no portion of either the first or second structural connectors makes contact with the striking face section, wherein the golf club head satisfies the equation $V_{ballnorm} \geq 0.0356x+140.82$, and wherein $$V_{ballnorm} = \frac{m_h V_{inh} + m_h V_{inh}\left[\frac{V_{cr}}{V_{cin}}\left(1+\frac{m_b}{m_c}\right)+\frac{m_b}{m_c}+\frac{V_{br}}{V_{bin}}\left(1+\frac{m_b}{m_p}\right)+\frac{m_b}{m_p}-0.822\right]}{m_h+m_b}.$$

In a further embodiment, the golf club head may comprise a crown insert that may be permanently affixed to the body to close the upper opening. In some embodiments, the crown insert may be composed of a carbon composite material, and each of the first and second stiffening members may be integrally cast with the body.

Yet another aspect of the present invention is a golf club head comprising a metal body comprising a striking face section, a sole section extending from a lower edge of the striking face section, a return section extending from an upper edge of the striking face section, and an aft end opposite the striking face section, the return section and sole section defining an upper opening, and the striking face section, sole section, and return section defining a hollow body interior, first and second structural connectors disposed within the hollow body interior and extending from the return section to the sole section, and a carbon composite crown insert permanently affixed to the body to close the upper opening, wherein each of the first and second structural connectors is located closer to the striking face section than to the aft end within the hollow body interior, wherein the golf club head has a volume of 420 cubic centimeters to 470 cubic centimeters, wherein the golf club head satisfies the equation $V_{ballnorm} \geq 0.0356x+141.19$, and wherein $$V_{ballnorm} = \frac{m_h V_{inh} + m_h V_{inh}\left[\frac{V_{cr}}{V_{cin}}\left(1+\frac{m_b}{m_c}\right)+\frac{m_b}{m_c}+\frac{V_{br}}{V_{bin}}\left(1+\frac{m_b}{m_p}\right)+\frac{m_b}{m_p}-0.822\right]}{m_h+m_b}.$$

In some embodiments, the first structural connector comprises an upper end proximate the return section and a lower end proximate the sole section, the upper end is spaced a first distance from the striking face section, and the lower end is spaced a second distance from the striking face section that is greater than the first distance. In a further embodiment, the first distance is 0.120 inch to 0.150 inch, and the second distance is 0.180 inch to 0.210 inch. In another embodiment, each of the first and second structural connectors has a length of 1.00 inch to 2.50 inches, the first structural connector extends approximately parallel with the second structural connector, and the first structural connector is spaced a distance of 0.75 inch to 1.50 inch from the second structural connector.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
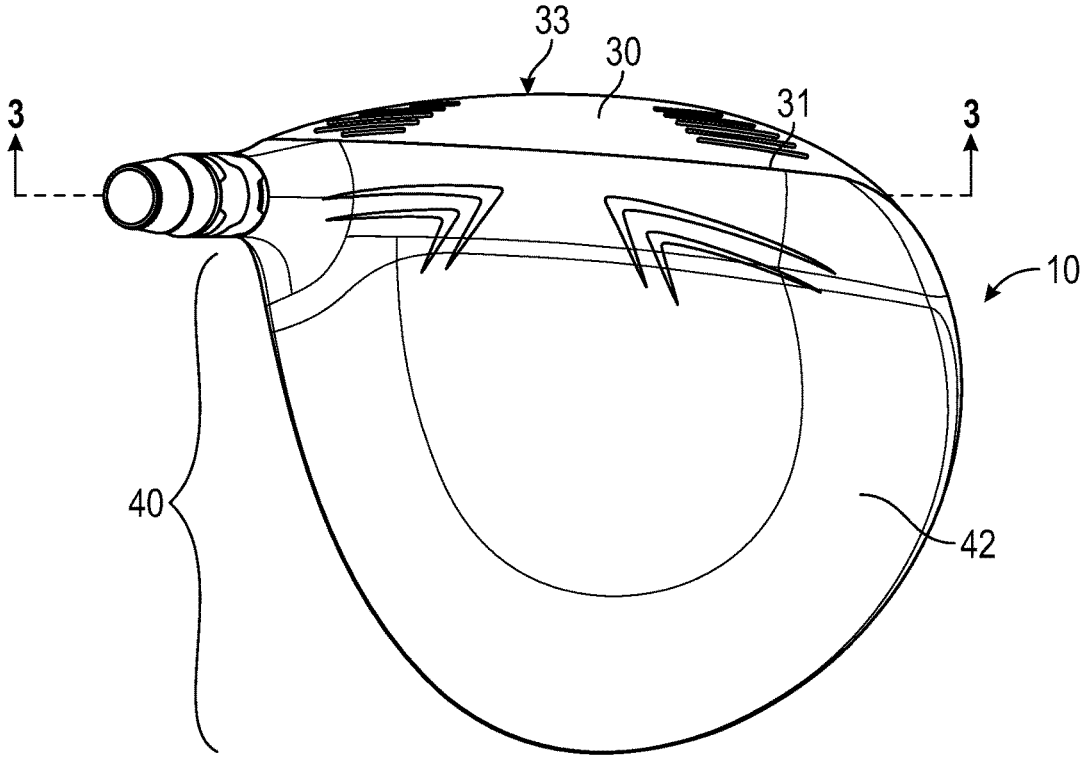
FIG. 1 is a top elevational view of the preferred embodiment of a golf club head with structural connectors.
Figure 2:
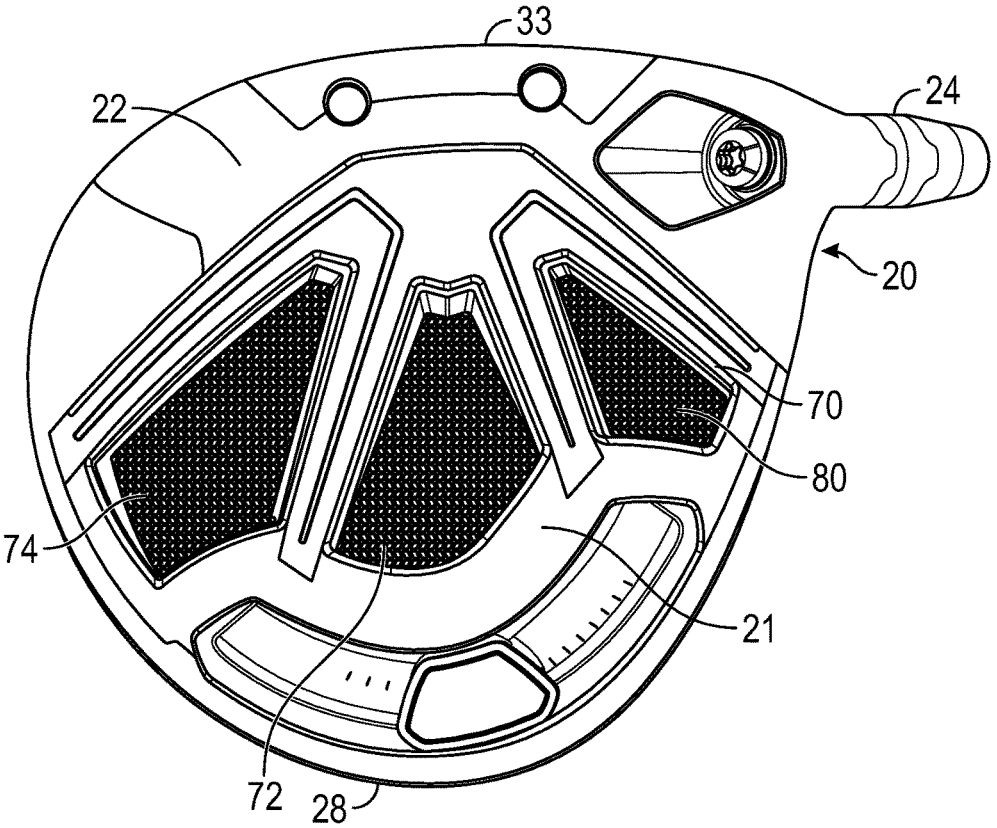
FIG. 2 is a sole elevational view of the golf club head shown in FIG. 1.

A preferred embodiment of the golf club head 10 with structural connectors is shown in FIGS. 1-8. The golf club head 10 preferably includes a body 20 having a striking face section 30 with a face center 34, a return section 32 extending rearwards away from an upper edge 31 of the striking face section 30, sole section 22 extending rearwards away from a lower edge 33 of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. The body 20 also includes three cutouts 70, 72, 74 in a center area 21 of the sole section 22, which are closed by a cover piece 80 having a density that is lower than the density of the material used to make the body 20. Each of the crown section 40 and cover piece 80 preferably is composed of a carbon composite material, while the body 20 is composed of a metal material such as titanium alloy or steel.

Within the hollow interior 27, two structural connectors 50, 52 extend from the sole section 22 upward to the return section 32 approximately parallel with the rear surface 36 of the striking face section 30 and with each other. In an alternative embodiment, the structural connectors 50, 52 extend to the crown insert 42 instead; what is important is that the structural connectors 50, 52 connect the crown section 40 to the sole section 22 proximate the striking face section 30, without making contact with any portion of the striking face section 30, even when the striking face section 30 impacts a golf ball. The structural connectors 50, 52 must, in any event, be closer to the striking face section 30 than to the aft end 28 of the body 20.

Figure 3:
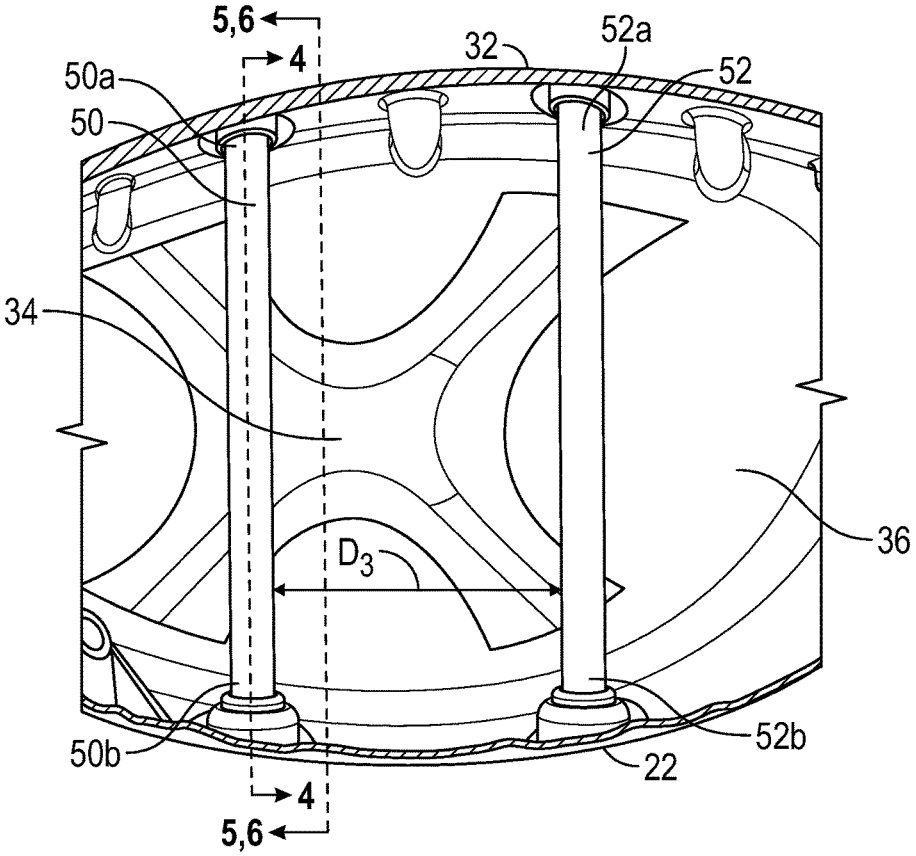
FIG. 3 is a cross-sectional view of the golf club head shown in FIG. 1 along lines 3-3.
Figure 4:
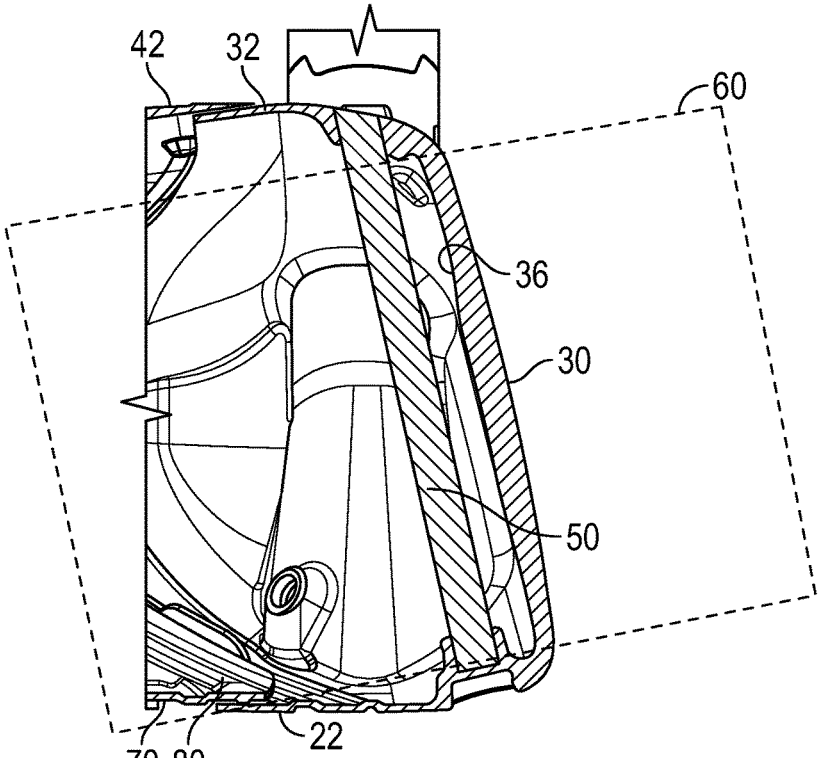
FIG. 4 is a cross-sectional view of the golf club head shown in FIG. 3 along lines 4-4.

As shown in FIG. 3, the preferred embodiment has two structural connectors 50, 52, each of which is a solid rod composed of a lightweight, strong metal material such as titanium alloy or steel, though in an alternative embodiment the structural connectors 50, 52 each may be a hollow tube or other hollow structure made of a strong lightweight metal or a composite material. In another embodiment, the golf club head 10 may include both the solid rod and hollow types of structural connectors 50. The structural connectors 50, 52 preferably are co-cast with the body 20 using a wax molding process, though in alternative embodiments may be added after the body 20 is manufactured and secured to the body 20 via welding, brazing, solder, or adhesive, and/or mechanically.

In the preferred embodiment, each of the structural connectors 50, 52 has a diameter of 0.050 inch to 0.200 inch and a length of 1 to 2.5 inches. The structural connectors 50, 52 are both preferably located within 1 inch of the rear surface 36 of the striking face section 30 measured along a vertical plane 60 extending through the face center 34 perpendicular to the striking face section 30. No portion of any structural connectors 50, 52 should be located outside of this 1-inch range; in fact, it is more preferable for each structural connector 50, 52 to be located even closer to the rear surface 36 of the striking face section 30. In the preferred embodiment, the structural connectors are spaced 0.136 inch to 0.210 inch from the rear surface 36, with the upper end 50*a*, 52*a* of each structural connector 50, 52 spaced a distance $D_1$ that is slightly closer to the rear surface 36 than the spacing $D_2$ of the lower end 50*b*, 52*b*. In the preferred embodiment, $D_1$ ranges from 0.120 inch to 0.150 inch, while $D_2$ ranges from 0.180 inch to 0.210 inch. The structural connectors 50, 52 are also spaced from one another by a distance $D_3$ of 0.500 to 2.00 inch, more preferably approximately 0.75 to 1.50 inch, and most preferably approximately 1.00 inch. This positioning of the structural connectors 50, 52 optimizes the normalized ball speed relationship to Characteristic Time (CT), as measured in μs by the U.S. Golf Association (USGA) CT test.

Figure 9:
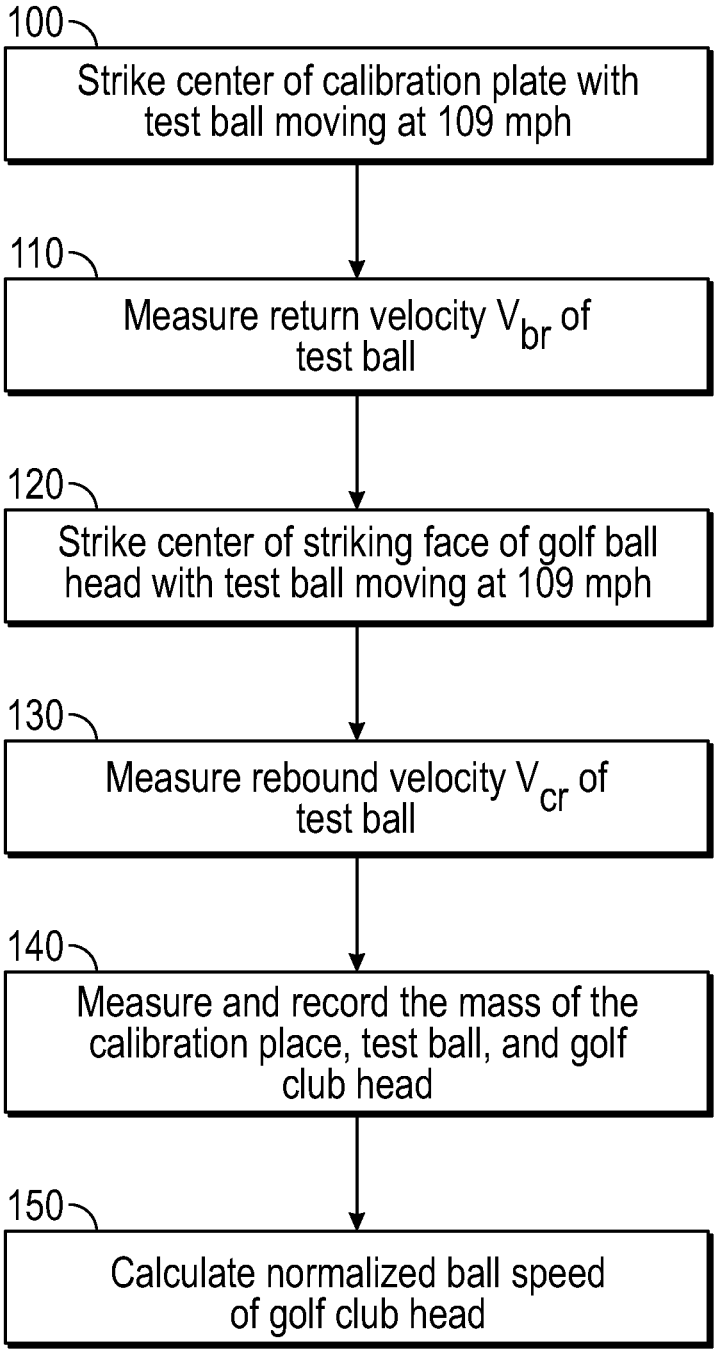
FIG. 9 is a flow chart describing how to calculate the normalized ball speed of a golf club head, including the embodiment shown in FIG. 1.

Normalized ball speed removes the variable effect of a golf club head's mass and loft, and the construction of a particular golf ball, from testing the speed of a golf ball upon impact with any given golf club head, including the golf club head 10 of the present invention; in other words, it allows an apples-to-apples comparison of golf club head performance. Normalized ball speed can be determined for a golf club head using the following steps, which are also outlined in the flow chart of FIG. 9.

Figure 10:
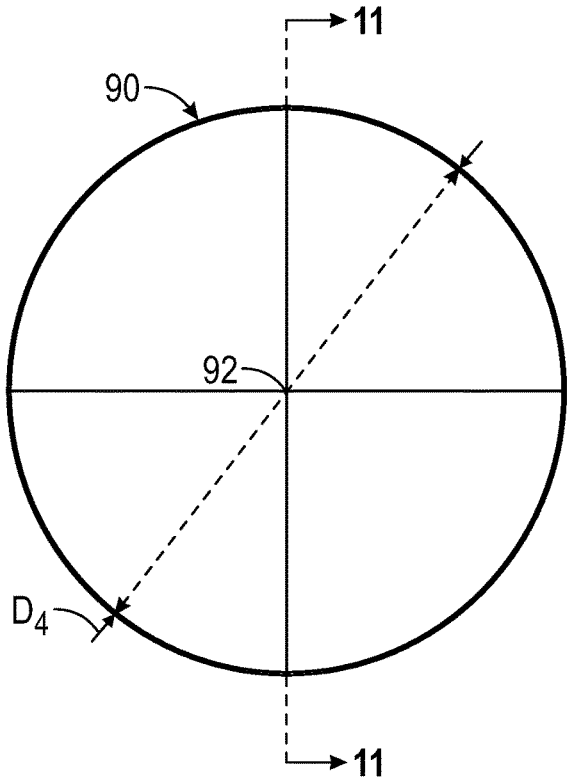
FIG. 10 is a top plan view of an exemplary calibration plate used to calculate normalized ball speed of a golf club head.
Figure 11:
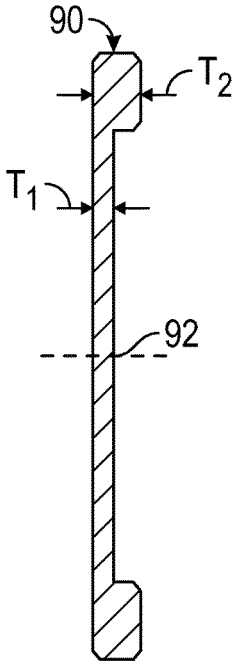
FIG. 11 is a cross-sectional view of the calibration plate shown in FIG. 10 along lines 11-11.

First, provide a titanium 6-4 calibration plate 90 with a mass of approximately 190 grams, a diameter $D_4$ of approximately 4 inches, a minimum thickness $T_1$ of approximately 0.100-0.150 inch, and a maximum thickness $T_2$ of approximately 0.200-0.400 inch, as shown in FIGS. 10 and 11, and strike the center 92 of the calibration plate with a test golf ball moving at approximately 109 mph (step 100). Measure the return velocity $V_{br}$ of the ball (step 110). Then, strike the same test golf ball, again traveling at approximately 109 mph, with the center 34 of the striking face section 30 of the golf club head 10 being assessed (step 120), and measure the rebound velocity $V_{cr}$ of the test golf ball (step 130). Next, measure and record the mass of the plate $m_p$, golf ball $m_b$, golf club head 10 $m_c$, measured head test ball in velocity (109 mph target) $V_{cin}$, measured plate test ball in velocity (109 mph target) $V_{bin}$, measured head test ball return velocity $V_{cr}$, and measured plate test ball return velocity $V_{br}$ (step 140). Finally, calculate the normalized ball speed ($V_{ballnorm}$) using the following equation (step 150):

$$V_{ballnorm} = \frac{m_h V_{inh} + m_h V_{inh}\left[\frac{V_{cr}}{V_{cin}}\left(1+\frac{m_b}{m_c}\right)+\frac{m_b}{m_c}+\frac{V_{br}}{V_{bin}}\left(1+\frac{m_b}{m_p}\right)+\frac{m_b}{m_p}-0.822\right]}{m_h+m_b}$$

In this equation, $V_{inh}$ is 100 and $m_h$ is 200.

Figure 12:
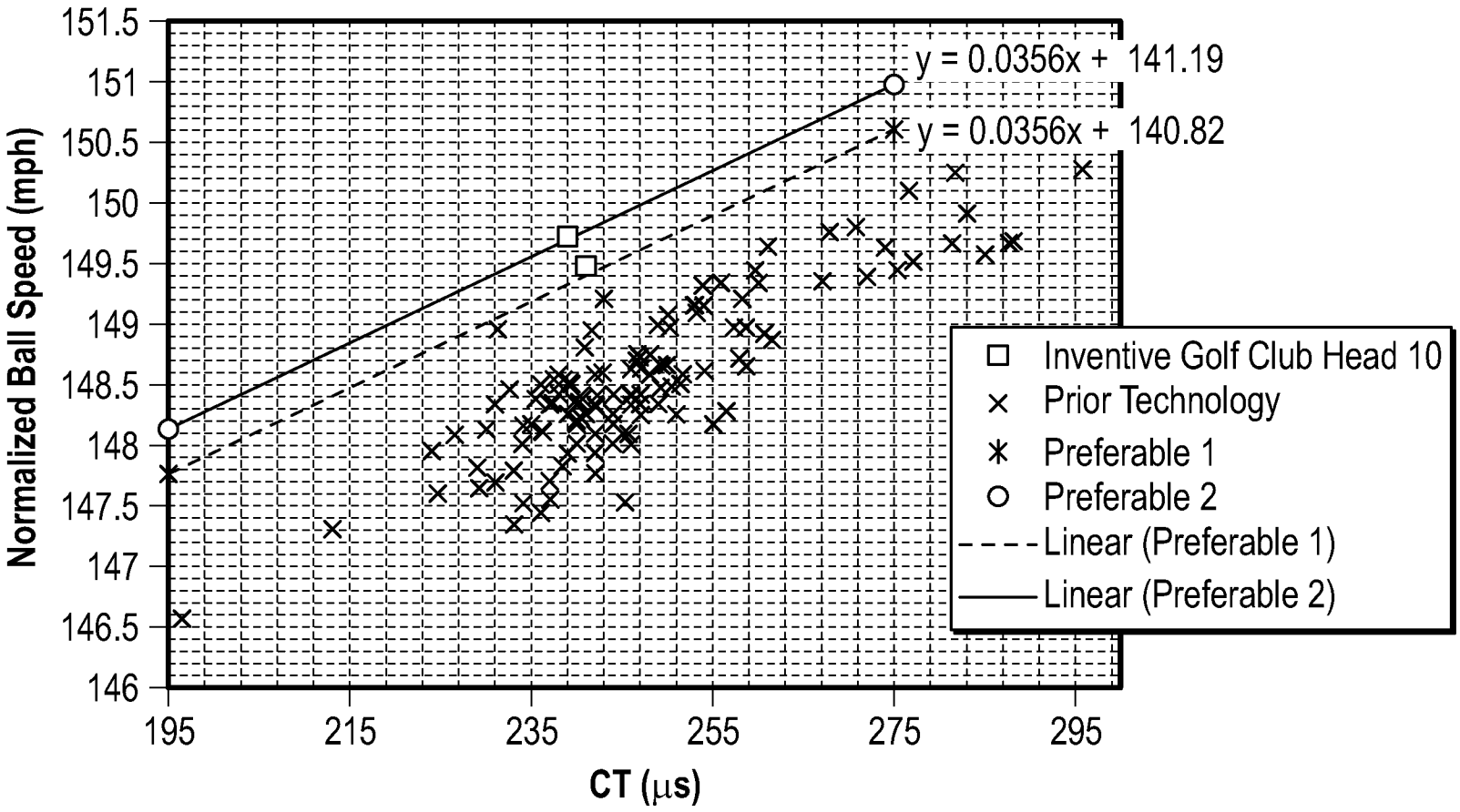
FIG. 12 is a graph showing the relationship between normalized ball speed (y-axis) and Characteristic Time (μs) (x-axis) of prior art golf club heads and the golf club head described herein.
Figure 13:
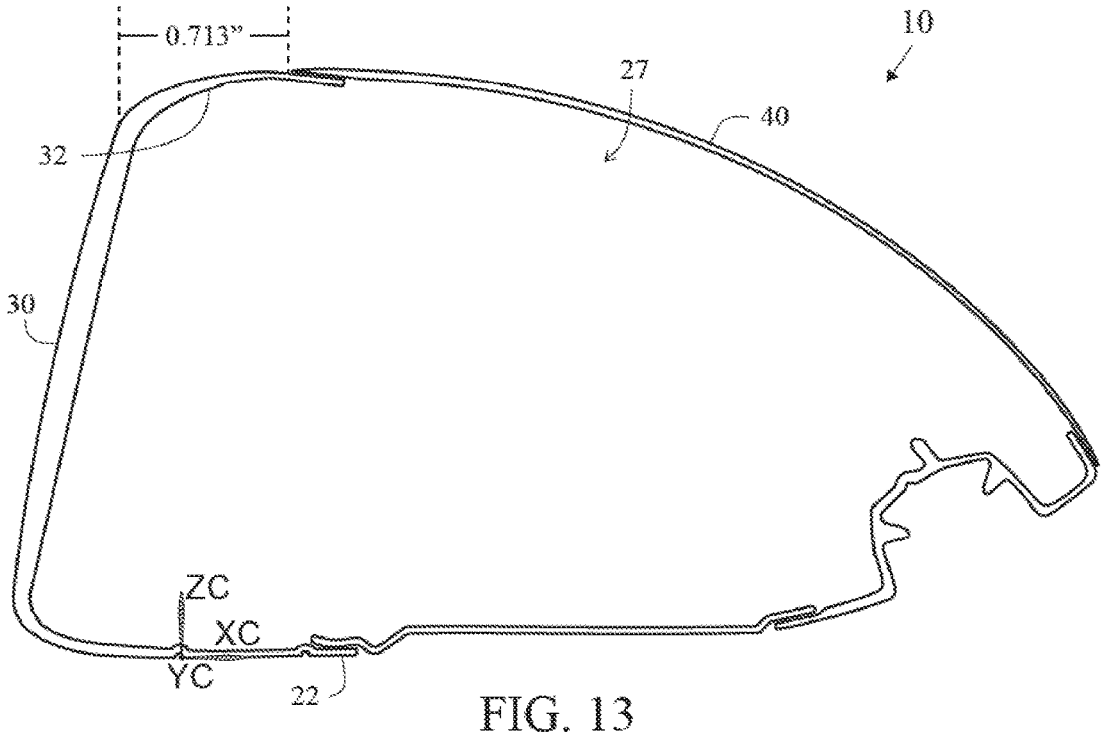
FIG. 13 is a cross-sectional view of a golf club head.
Figure 14:
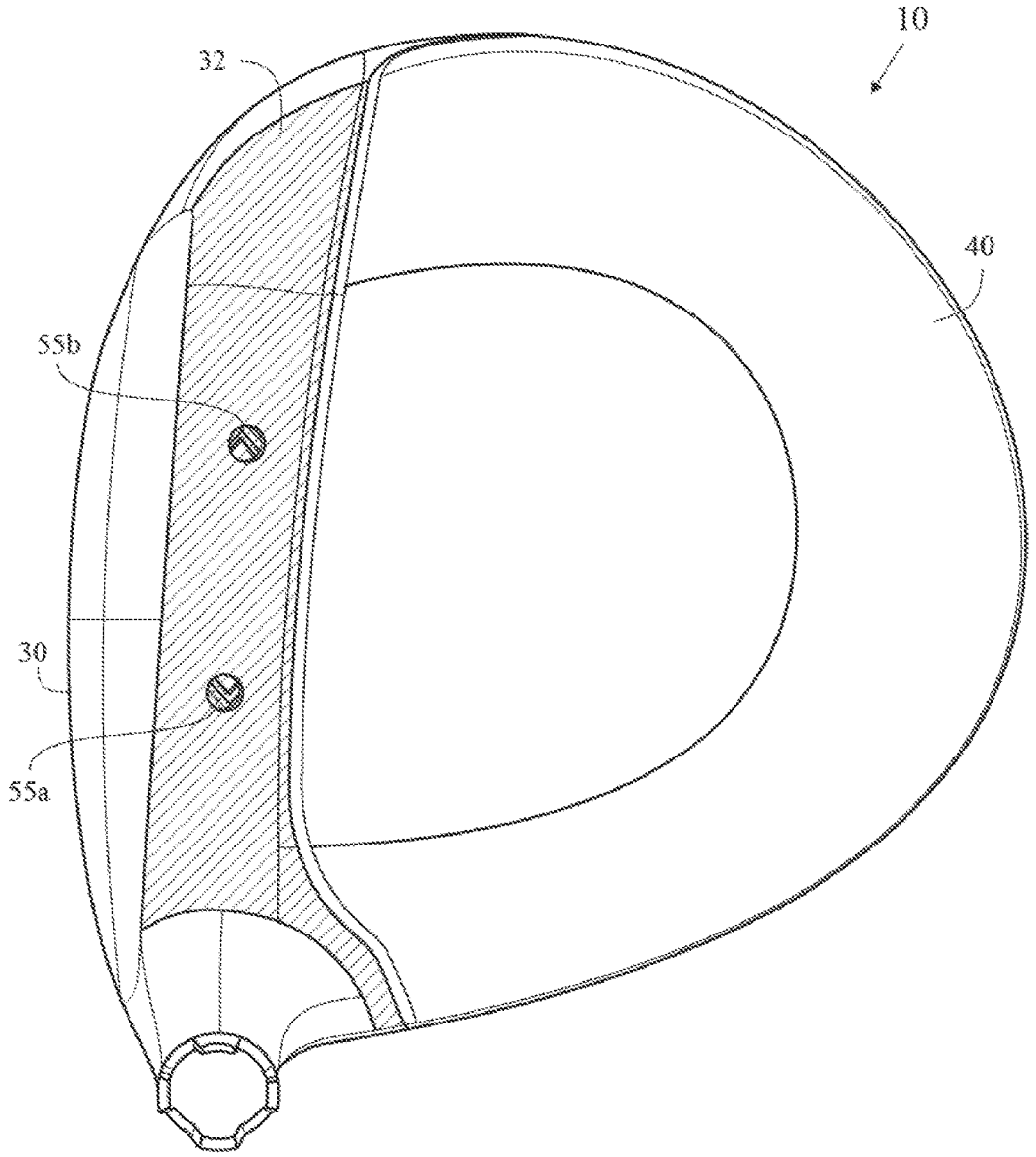
FIG. 14 is a top plan view of a golf club head.
Figure 15:
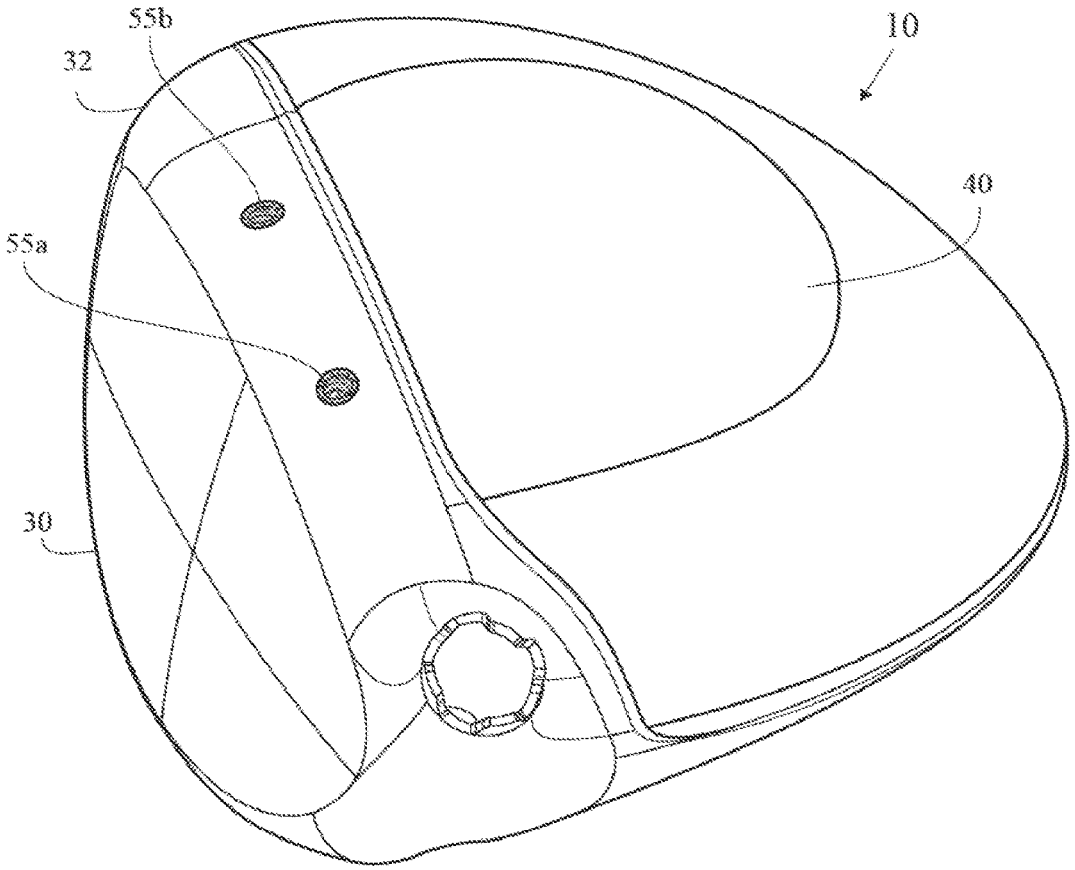
FIG. 15 is a top perspective view of a golf club head.
Figure 16:
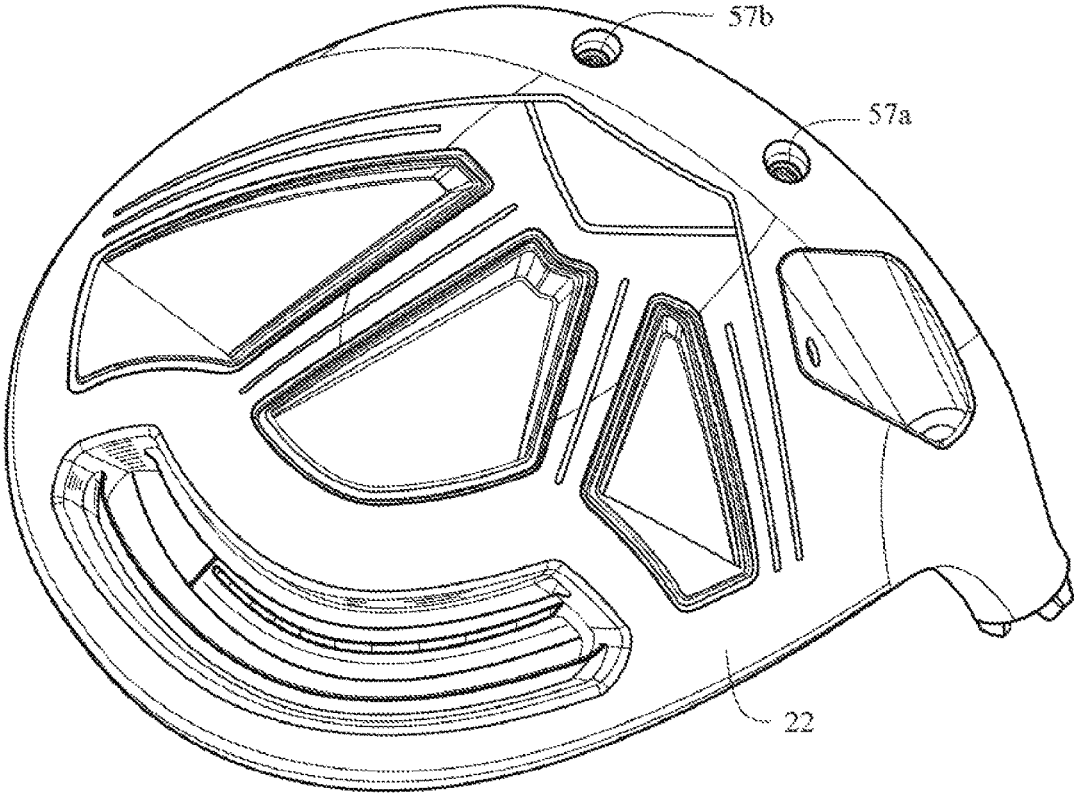
FIG. 16 is a bottom perspective view of a golf club head.

The golf club head 10 of the present invention has a $V_{ballnorm} \geq 0.0356x+140.82$, and more preferably a $V_{ballnorm} \geq 0.0356x+141.19$. The positioning of the structural connectors 50, 52 allow the golf club head 10 to satisfy this equation; as shown in FIG. 12, prior art golf club heads, which do not include the structural connector structure, fall well short of this performance metric.

In addition to optimizing the normalized ball speed of the golf club head 10, locating the structural connectors 50, 52 within the region of the golf club head 10 defined above has the greatest stress-reducing effect on the golf club head 10. If any of the structural connectors 50, 52 are placed more than 1 inch away from the rear surface 36 of the striking face section 30, they will not have a noticeable effect on the stress placed on the striking face section 30 when the golf club head 10 is in use, and will use discretionary mass without providing a significant performance benefit.

FIGS. 13-19 illustrate the contact surface area 55*a* and 55*b* between each of the structural connecting 50 and 52 and the return section 32 of the body 20 of the golf club head 10. The cast metal body 20 preferably comprises a toe structural connector 52, a heel structural connector 50, a striking face section 30, a crown return portion 32 and a sole section 22.

Figure 3A:
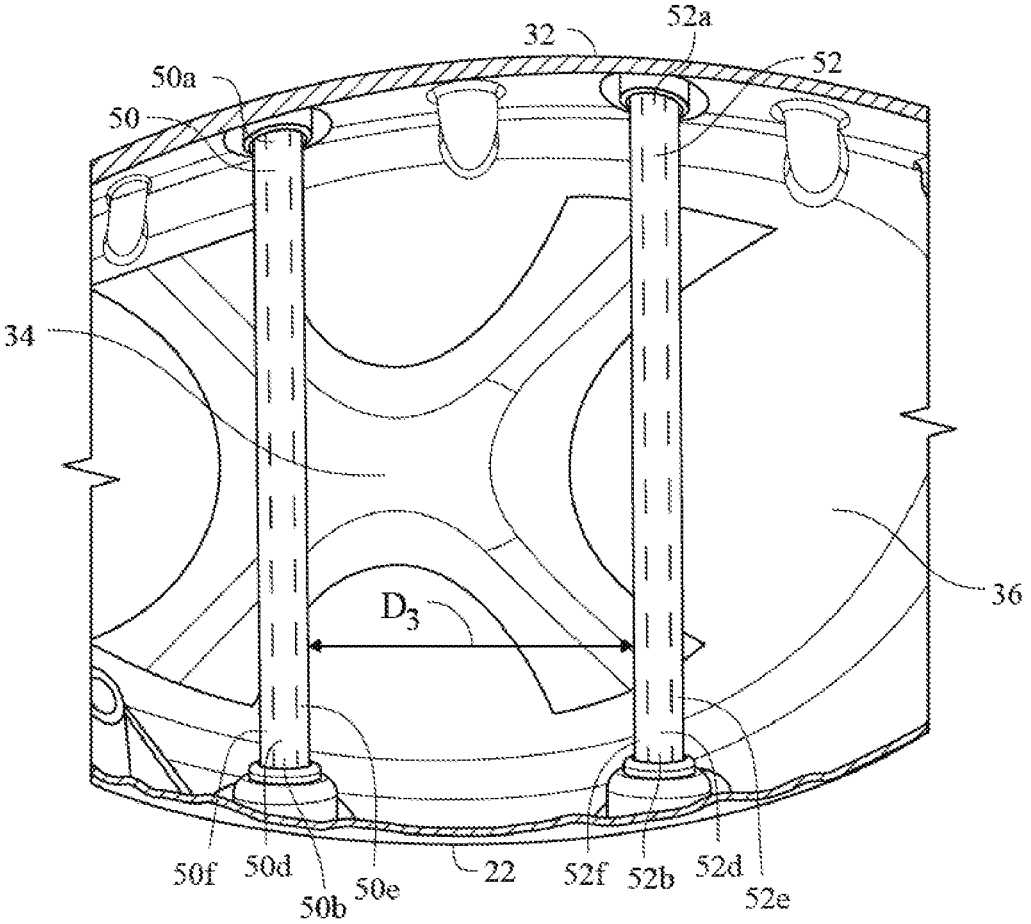
FIG. 3A is a cross-sectional view of the golf club head shown in FIG. 1 along lines 3-3 illustrating the surfaces of the structural connectors.
Figure 6:
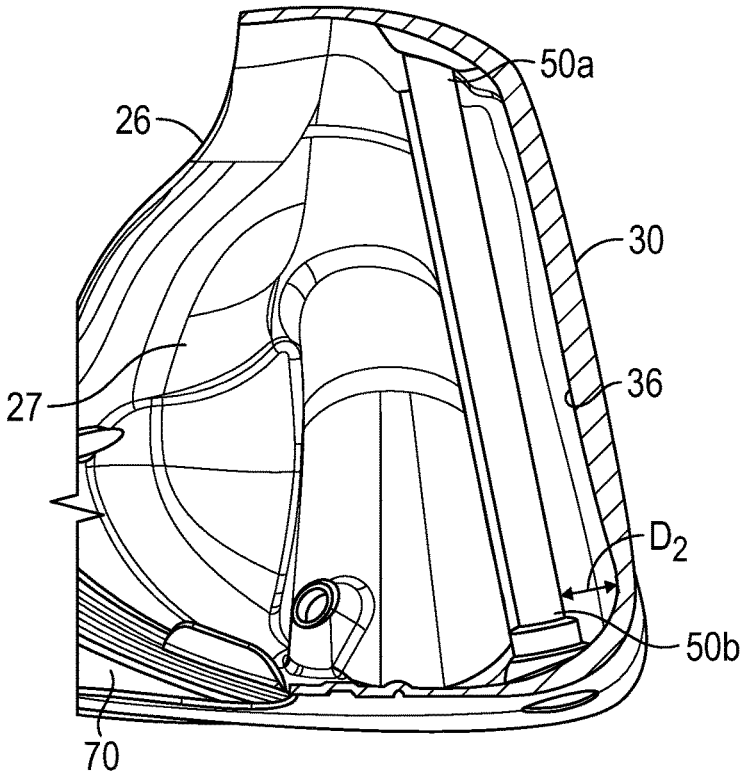
FIG. 6 is a cross-sectional view of the golf club head shown in FIG. 3 along line 6-6.
Figure 19:
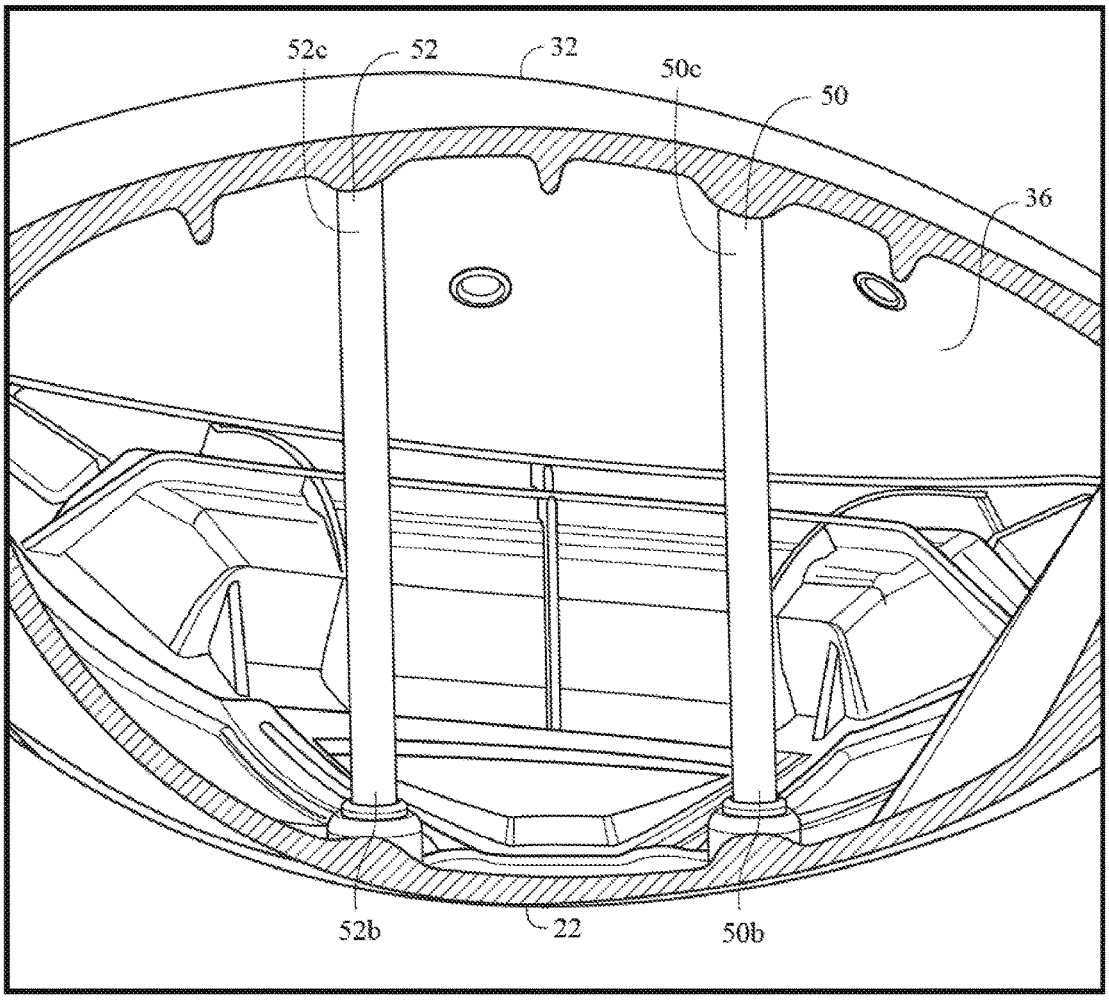
FIG. 19 is a front elevation view of a golf club head with structural columns with a face removed to illustrate the interior of the golf club head.
Figure 20:
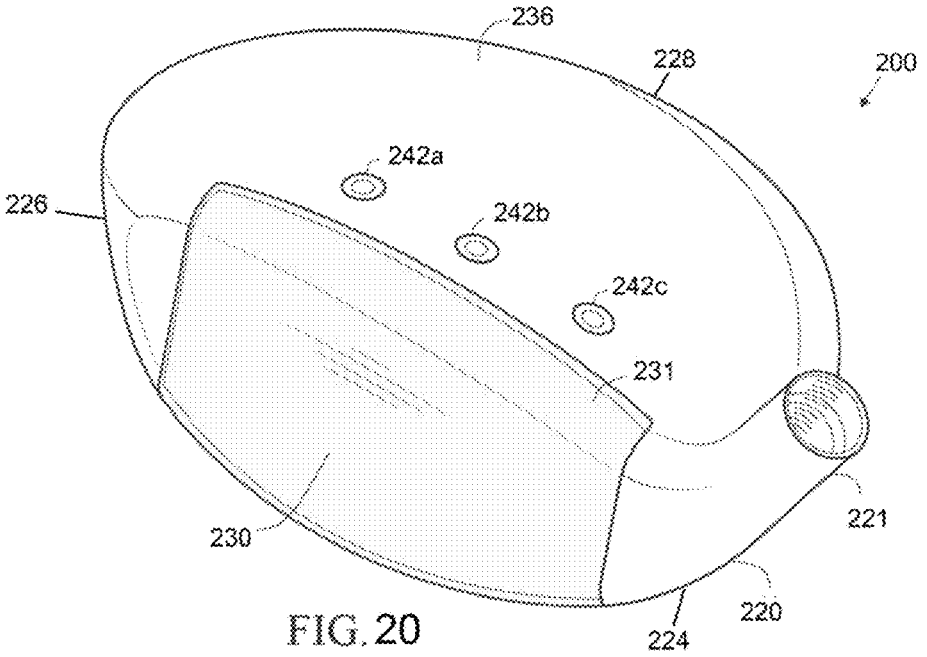
FIG. 20 is a top perspective view of another embodiment of a golf club head with structural connectors
Figure 21:
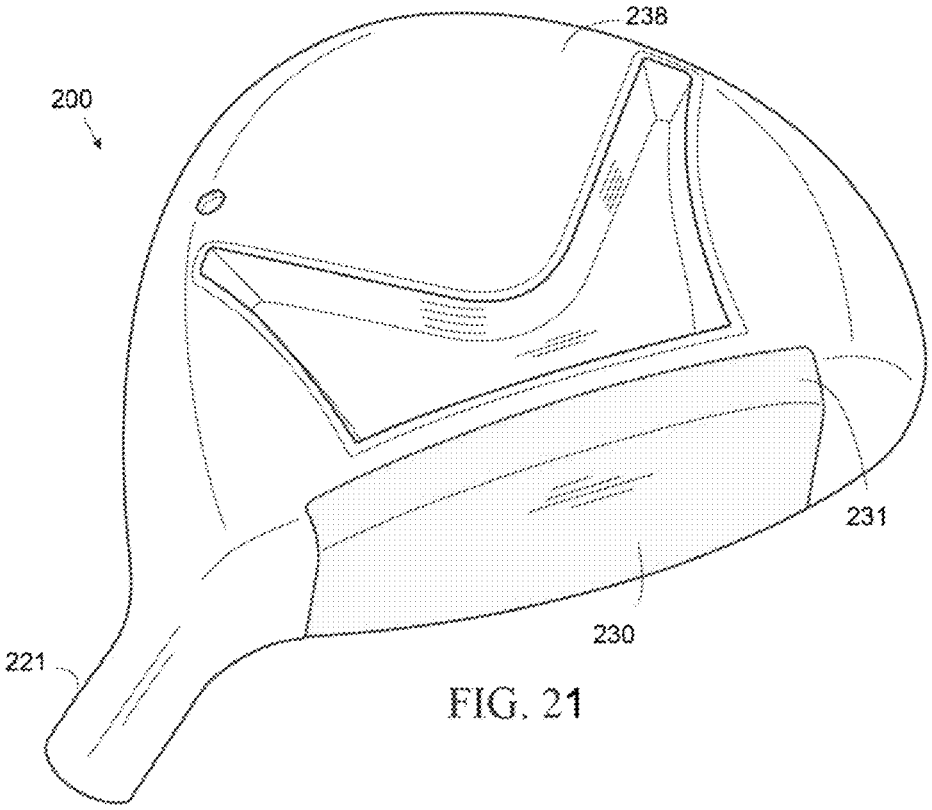
FIG. 21 is a sole perspective view of the golf club head shown in FIG. 20.
Figure 22:
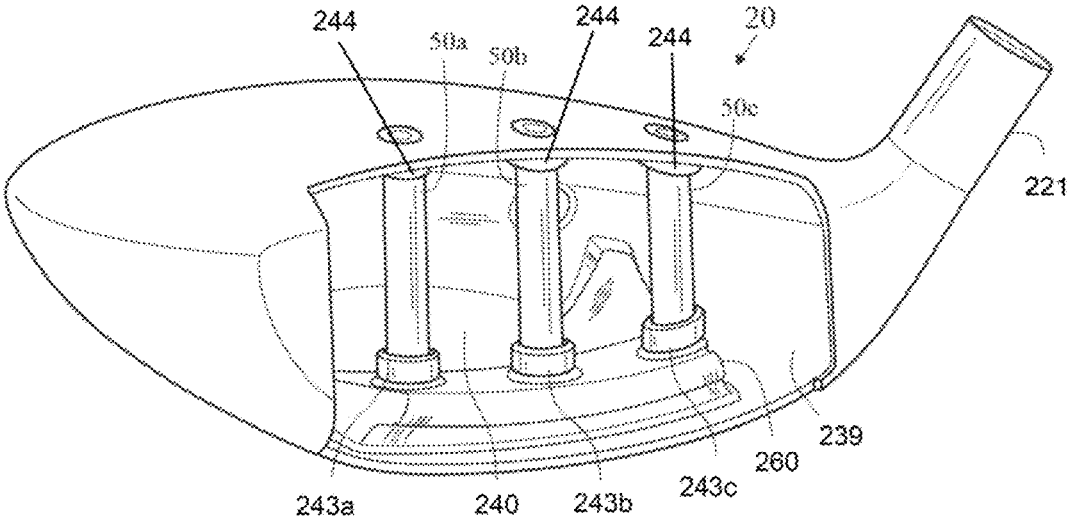
FIG. 22 is a front perspective view of the golf club head shown in FIG. 20 with the face component removed to illustrate an interior.
Figure 23:
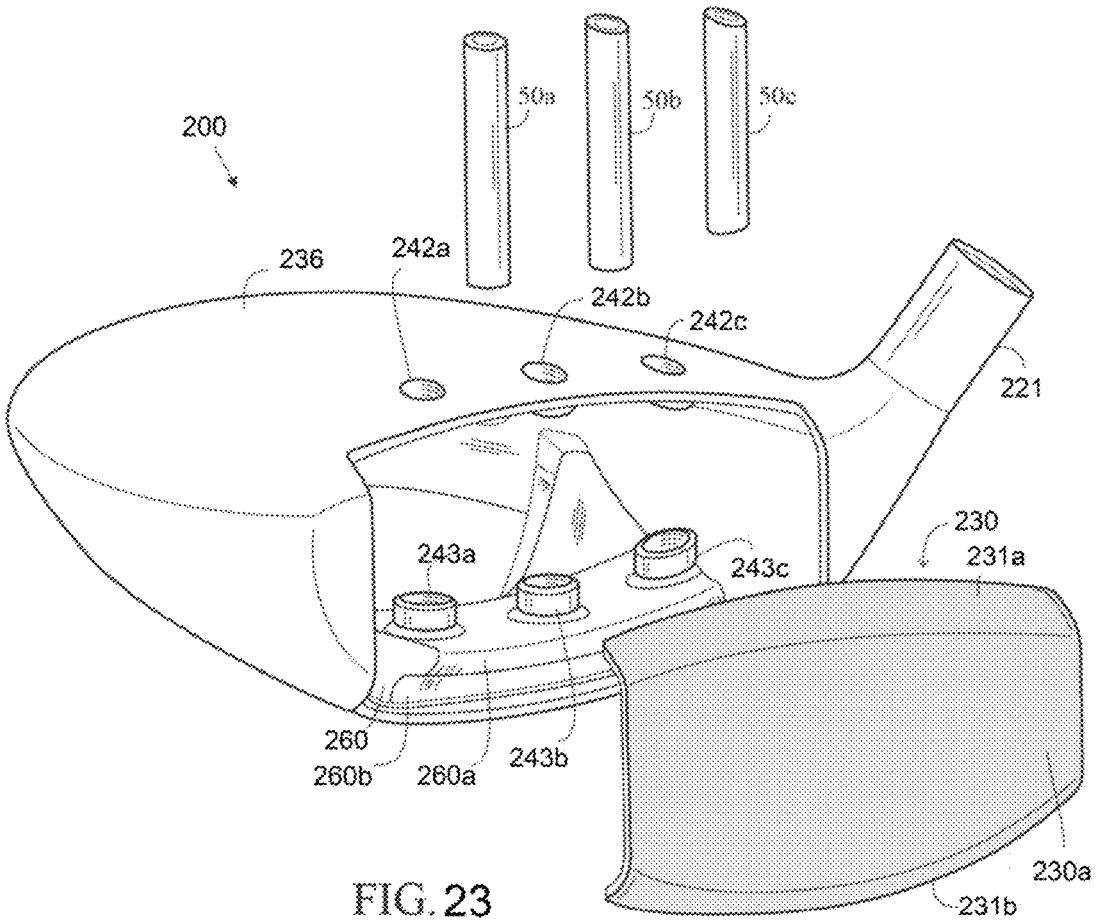
FIG. 23 is an exploded view of the golf club head shown in FIG. 20.

In one embodiment, shown in FIGS. 3A and 19, the toe structural connector 52 comprises a body with a crown end 52*a*, a sole end 52*b*, a forward surface 52*c* (shown in FIG. 19), a rearward surface 52*d*, a heel surface 52*f* and a toe surface 52*e*. The heel structural connector 50 comprises a body with a crown end 50*a*, a sole end 50*b*, a forward surface 50*c* (shown in FIG. 19), a rearward surface 50*d*, a heel surface 50*f* and a toe surface 50*e*. In this embodiment, each of the heel structural connector 50 and the toe structural connector 52 has a radius of curvature preferably ranging from 0.02 inch to 0.1 inch, more preferably from 0.025 inch to 0.05 inch, and most preferably 0.0395 inch. The striking face section 30 has an exterior surface 30*a*, an interior surface 36, an upper perimeter 31 and a lower perimeter 33. The crown return portion 32 extends rearward from the upper perimeter 31 of the striking face section 30 preferably approximately 0.5 inch to 1.5 inches, more preferably 0.6 inch to 1.0 inch, and most preferably approximately 0.725 inch. The sole section 22 portion extends rearward from the lower perimeter 33 of the striking face section 30. The crown end 52*a* of the toe structural connector 52 is connected to the crown return portion 32. The crown end 50*a* of the heel structural connector 50 is connected to the crown return portion 32. The sole end 52*b* of the toe structural connector 52 is connected to the sole section 22. The sole end 50*a* of the heel structural connector 50 is connected to the sole section 22.

Figure 17:
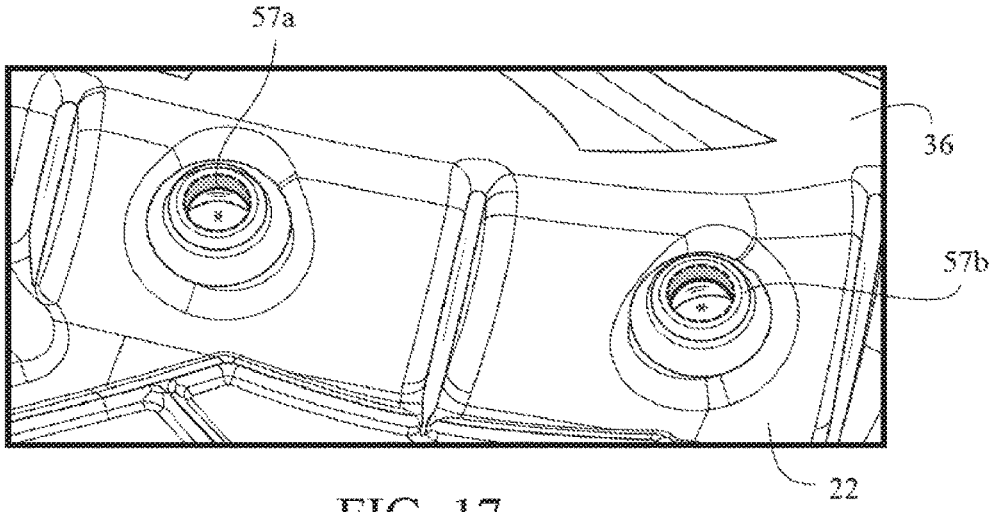
FIG. 17 is an isolated internal view of a golf club head.
Figure 18:
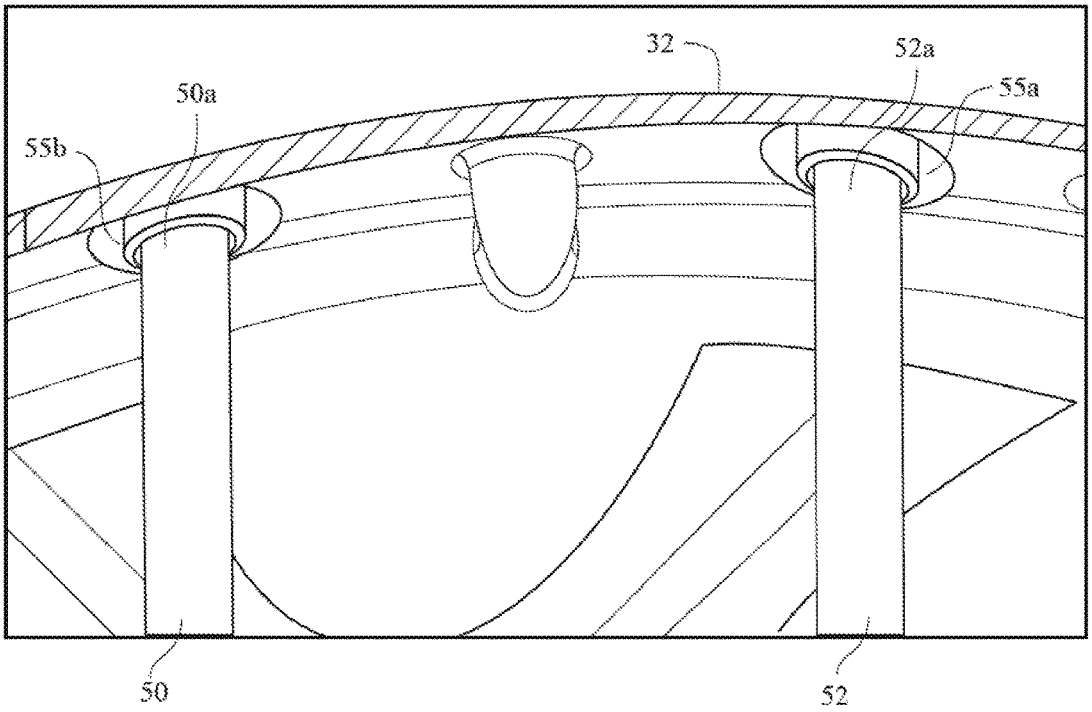
FIG. 18 is an isolated internal view of an intersection of the structural connectors and a return section of a golf club head.

A contact surface area 57*a*, 57*b* between the crown return portion 32 and both of the crown end 52*a* of the toe structural connector 52 and the crown end 50*a* of the heel structural connector 50*a* ranges from 1% to 5% of the surface area of the crown return portion 32. The surface area of the crown return portion ranges from 2.5 square inches to 4.0 square inches. The contact surface area 55*a* between the crown return portion 32 and the crown end 52*a* of the toe structural connector 52 preferably ranges from 0.02 square inches to 0.1 square inch, more preferably from 0.035 square inch to 0.075 square inch, and most preferably is 0.045 square inch. As shown in FIG. 18, the contact surface area 55*b* between the crown return portion 32 and the crown end 50*a* of the heel structural connector 50 preferably ranges from 0.02 square inches to 0.1 square inch, more preferably from 0.035 square inch to 0.075 square inch, and most preferably is 0.045 square inch. As shown in FIG. 17, the contact surface area 57*a* between the sole section 22 and the sole end 52*b* of the toe structural connector 52 preferably ranges from 0.015 square inches to 0.1 square inch, more preferably from 0.025 square inch to 0.05 square inch, and most preferably is 0.03 square inch. The contact surface area 57*b* between the sole section 22 and the sole end 50*b* of the heel structural connector 50 preferably ranges from 0.015 square inches to 0.1 square inch, more preferably from 0.025 square inch to 0.05 square inch, and most preferably is 0.03 square inch.

The toe structural connector 52 and the heel structural connector 50 preferably attenuate movement of the crown return portion 32 and the sole section 22 when the striking face section 30 impacts a golf ball.

The toe structural connector 52 and the heel structural connector 50 each preferably have a length from the sole end 50*b*, 52*b* to the crown end 50*a*, 52*a* ranging from 1 inch to 2.5 inches. As shown in FIG. 3A, the heel surface 52*f* of the toe structural connector 52 is a distance ranging from 0.75 inch to 1.5 inches from the toe surface 50*e* of the heel structural connector 50. A contact area 55*a*, 55*b*, between the crown return portion 32 and each of the toe structural connector 52 and the heel structural connector 50 preferably ranges from 0.02 square inches to 0.04 square inches.

Figure 5:
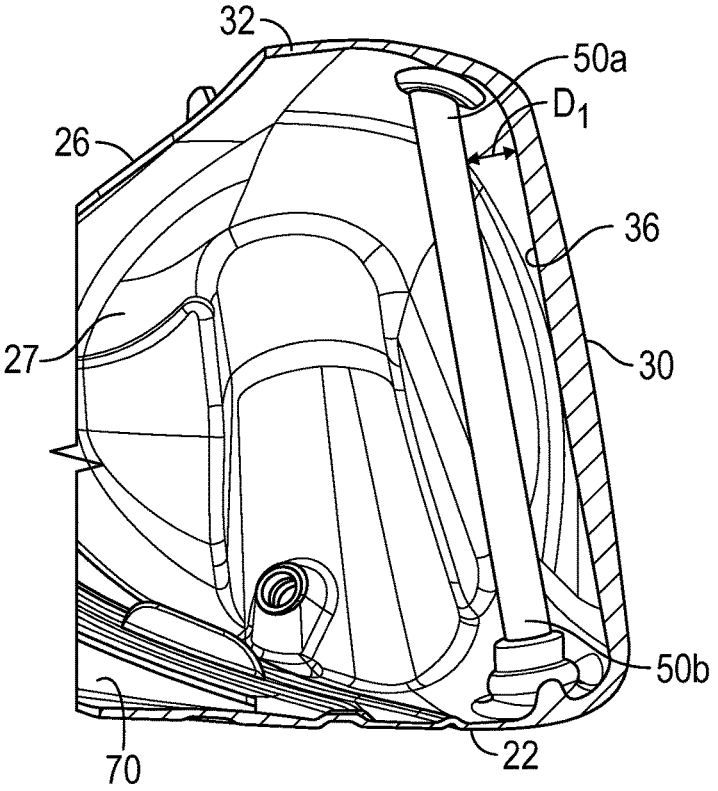
FIG. 5 is a cross-sectional view of the golf club head shown in FIG. 3 along line 5-5.
Figure 5A:
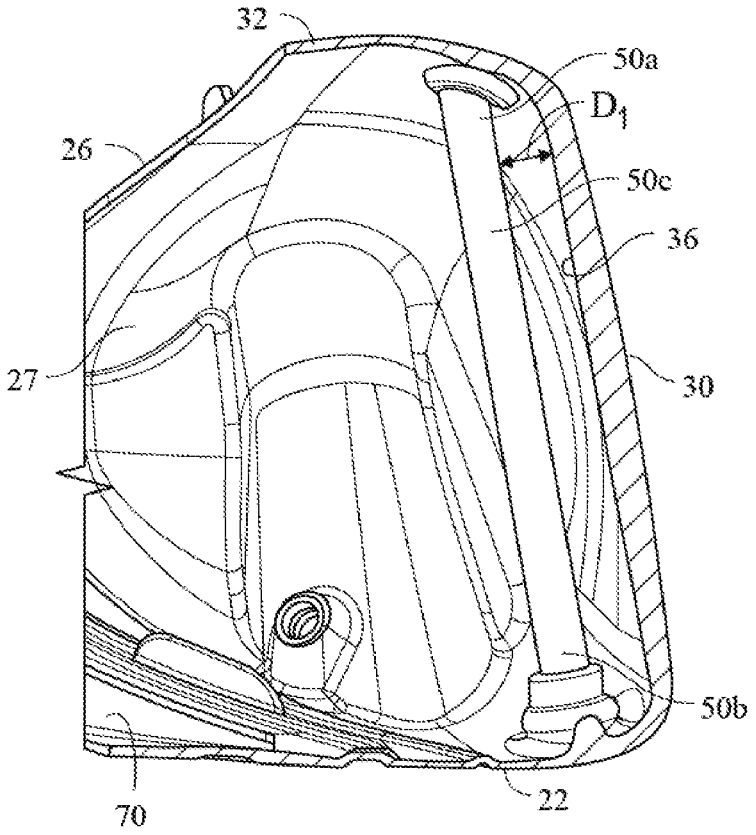
FIG. 5A is a cross-sectional view of the golf club head shown in FIG. 3 along line 5-5.
Figure 7:
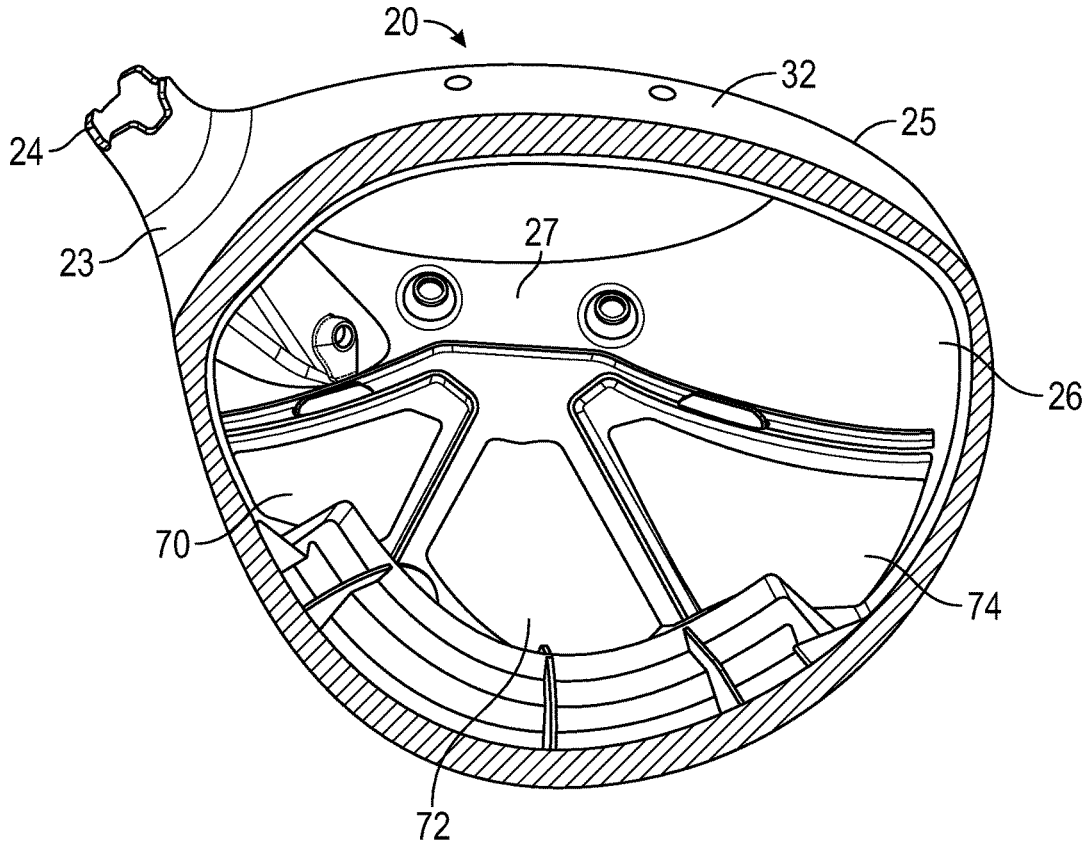
FIG. 7 is a top perspective view of the golf club head shown in FIG. 1 with its crown insert and sole cover piece removed.
Figure 8:
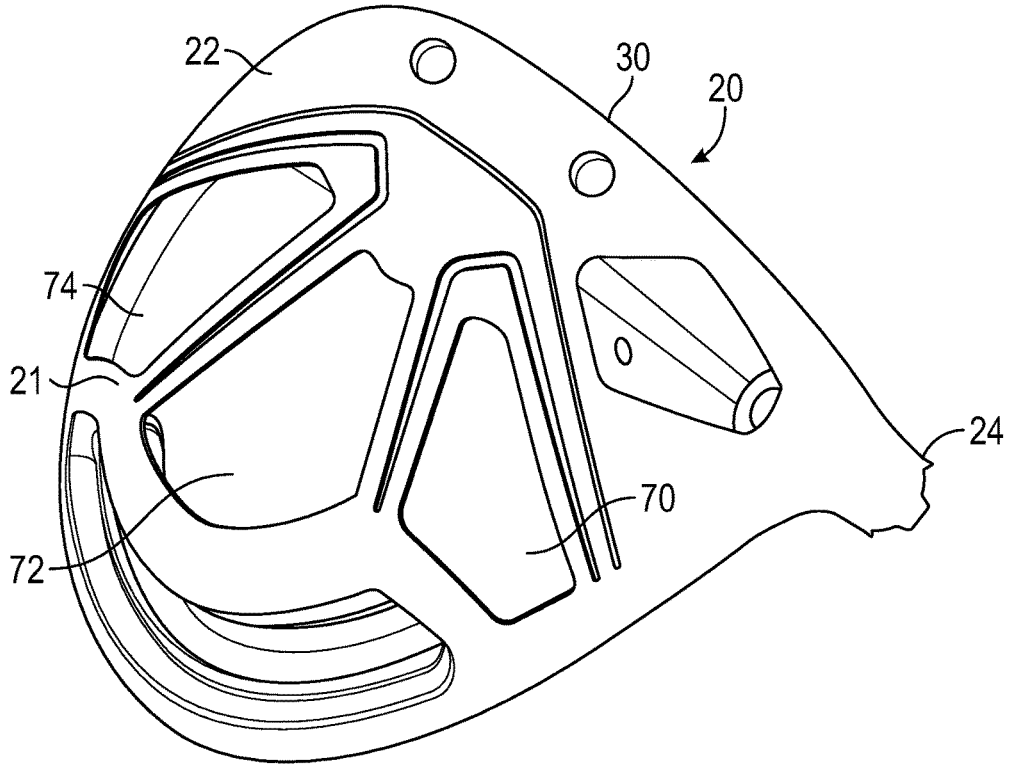
FIG. 8 is a sole perspective view of the embodiment shown in FIG. 7.

As shown in FIG. 5A, the forward surface 50*c* and 52*c* of each of the toe structural connector 52 and the heel structural connector 50 is at least 0.120 inch rearward from the interior surface 36 of the striking face section 30 and the rearward surface 50*d*, 52*d* of each of the toe structural connector 52 and the heel structural connector 50 is no more than 1.0 inch rearward from the interior surface 36 of the striking face section 30.

As shown in FIGS. 20-23, another embodiment of a golf club head 200 is generally designated. The golf club head 200 preferably includes a body 220 having a hosel 221, a crown section 236, a sole section 238 with a protrusion 260, a heel end 224, a toe end 226, and an aft end 228. A face component 230 is placed over an opening 239 in the body 220. The body 220, along with the face component 230, preferably defines a hollow interior 240. Within the hollow interior 240, multiple structural connectors 50 extend from the protrusion 260 of the sole section 238 upward to the crown section 236.

The plurality of structural connectors 50 preferably ranges from two structural connectors to eight structural connectors. Each of the plurality of structural connectors 50 preferably has a diameter ranging from 2 millimeters to 5 millimeters. Each of the plurality of structural connectors 50 preferably has a length ranging from 30 millimeters to 60 millimeters. Each of the plurality of structural connectors 50 is preferably positioned within 11 millimeters of an interior surface of the face component 230. The mass of each of the plurality of structural connectors 50 preferably ranges from 0.5 gram to 3 grams, more preferably from 1 gram to 2 grams, and most preferably each structural connectors 50 has a mass of 1.5 grams. The crown section 236 preferably comprises a plurality of apertures 242 with bosses 244 extending therefrom for support. Each of the plurality of apertures 42*a*, 42*b*, 42*c* and their respective bosses 244*a*, 244*b*, 244*c* preferably corresponds to a structural connector 50*a*, 50*b*, 50*c* of the plurality of structural connectors 50. The protrusion 260 preferably comprises a plurality of bosses 243*a*, 243*b*, 243*c* each of which preferably corresponds to a structural connector 50*a*, 50*b*, 50*c* of the plurality of structural connectors 50. The structural connectors 50*a*, 50*b*, 50*c* can be glued into the bosses 243*a*, 243*b*, 243*c*.

The face component 230 preferably comprises a striking plate section 230*a* and return sections 231*a* and 231*b* that are approximately perpendicular to the striking plate section 230*a*. The face component 230 is preferably welded over the opening 239 of the body 220. The face component 230 is preferably composed of a metal that is different from the metal of the body 220. The face component 230 is preferably composed of a high performance metal material such as SP700 titanium alloy, carpenter steel, or the like. The face component 230 preferably has a varying thickness. Alternatively, the face section has a uniform thickness.

In order to achieve a low, frontward center of gravity (CG) without affecting a weld seam, the protrusion 260 is located inside the hollow interior 240 and proximate the opening 239, and extends from the heel end 224 to the toe end 226. This construction avoids creating welding problems, but still allows for discretionary mass to be located mostly low and forward in the golf club head 200. The protrusion 260 preferably has a base section 260*b* and an extension section 260*a*. The structural connectors 50 are positioned on the extension section 260*a* of the protrusion 260. The protrusion 260, which preferably is cast into the body 220 but may, in alternative embodiments, be welded or affixed mechanically to the body 220, extends upwards from the sole section 238 and protrudes from the opening 239 of the body 220. When the golf club head 200 is assembled, the protrusion 260 extends towards the face component 230 without making contact with the striking plate section 230*a*. The protrusion 260 preferably comprises at least 20% of the mass of the body 220, and more preferably 30% of the mass of the body 220. The protrusion 260 preferably ranges in mass from 30 grams to 60 grams. U.S. Pat. No. 8,414,420 for a Weighted Golf Club Head to Erickson is hereby incorporated by reference in its entirety herein.

When the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has a volume of approximately 450 cc to 460 cc.

The volume of the golf club head 10 also varies between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking face section 30 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a metal body comprising a sole section, a crown section, a front section having an opening, a hollow interior, and a protrusion extending from a heel side of the sole section to a toe side of the sole section;

a metal face component positioned over the opening, the face component comprising a striking plate section having an interior surface facing the hollow interior; and at least one structural connector comprising a body with a crown end, a sole end, a forward surface, a rearward surface, a heel surface, and a toe surface, wherein the at least one structural connector extends from the crown section to the protrusion, wherein the crown end of the at least one structural connector is connected to the crown section, wherein the sole end of the at least one structural connector is connected to the protrusion, wherein the at least one structural connector is located within 1 inch of the interior surface of the striking plate section, which improves the normalized ball speed relationship to characteristic time, wherein no portion of the at least structural connector makes contact with the striking plate section, wherein the protrusion extends upwards from the sole towards the striking plate section without touching the striking face, wherein the protrusion does not comprise any hollow regions, and wherein the at least one structural connector attenuates movement of the crown section and the sole section when the striking plate section impacts a golf ball.

2. The golf club head according to claim 1 wherein the golf club head has a volume ranging from 100 cubic centimeters to 300 cubic centimeters.

3. The golf club head according to claim 1, wherein the at least one structural connector comprises a toe structural connector and a heel structural connector, wherein each of the toe structural connector and heel structural connector is a solid rod, and wherein the toe structural connector is parallel with the heel structural connector.

4. The golf club head according to claim 3, wherein the toe structural connector is spaced a distance of 0.50 inch to 2.00 inch from the heel structural connector.

5. The golf club head according to claim 4, wherein the toe structural connector is spaced a distance of 0.75 to 1.50 inch from the heel structural connector.

6. The golf club head according to claim 5, wherein the toe structural connector is spaced approximately 1.00 inch from the heel structural connector.

7. The golf club head according to claim 3, wherein the each of the toe and heel structural connector extends approximately parallel with the interior surface of the striking plate section.

8. The golf club head according to claim 1, wherein each of the protrusion and the at least one structural connector is cast into the body, and wherein the body is composed of steel.

9. The golf club head according to claim 1, wherein the protrusion comprises a base section and an extension section.

10. The golf club head according to claim 1, wherein the face component comprises at least one return section that is approximately perpendicular to the striking plate section, and wherein the face component is welded to the body to close the opening.

11. The golf club head according to claim 10, wherein the face component is composed of a metal that is different from the metal of the body.

12. The golf club head according to claim 1, wherein the at least one structural connector is a solid metal rod, and wherein the at least one structural connector is located no more than 0.25 inch from the interior surface of the striking plate section.

13. The golf club head according to claim 1, further comprising an upper opening and a carbon composite crown insert, wherein the crown insert is permanently affixed to the body to close the upper opening.

14. A fairway wood-type golf club head comprising:

a metal body comprising a sole section, a crown section, an upper opening, a front section having a front opening, a hollow interior, and a protrusion extending from a heel side of the sole section to a toe side of the sole section within the hollow interior;

a crown insert permanently affixed to the body to close the upper opening, a metal face component welded to the body to cover the front opening, the face component comprising a striking plate section having an interior surface facing the hollow interior and a return section that is approximately perpendicular to the striking plate section;

a toe structural connector comprising a first connector body with a first crown end and a first sole end; and a heel structural connector comprising a second connector body with a second crown end and a second sole end, wherein each of the toe structural connector and the heel structural connector extends from the crown section to the protrusion, wherein each of the first crown end and the second crown end is connected to the crown section, wherein each of the first sole end and the second sole end is connected to the protrusion, wherein each of the toe structural connector and the heel structural connector is located within 0.25 inch of the interior surface of the striking plate section, wherein no portion of the toe structural connector or the heel structural connector makes contact with the striking plate section, wherein the toe structural connector and heel structural connector are parallel to each other and extend approximately parallel with the interior surface of the striking plate section, wherein the toe structural connector is spaced a distance of 0.50 inch to 2.00 inch from the heel structural connector, wherein the protrusion comprises a base section and an extension section, wherein the protrusion is cast into the body, wherein the protrusion extends upwards from the sole towards the striking plate section without touching the striking plate section, and wherein the toe structural connector and the heel structural connector attenuate movement of the crown section and the sole section when the striking plate section impacts a golf ball.

15. The fairway wood-type golf club head according to claim 14, wherein the crown insert is composed of a carbon composite material.

16. The fairway wood type golf club head according to claim 14, wherein the body is composed of a material selected from the group consisting of titanium alloy and steel.

17. The fairway wood type golf club head according to claim 16, wherein the face component is composed of a metal that is different from the metal of the body.

18. The fairway wood-type golf club head according to claim 14, wherein the toe structural connector has a length from the first sole end to the first crown end ranging from 1 inch to 2.5 inches, and wherein the heel structural connector has a length from the second sole end to the second crown end ranging from 1 inch to 2.5 inches.

19. The fairway wood-type golf club head according to claim 14, wherein the body of each of the toe structural connector and the heel structural connector is hollow.

20. The fairway wood-type golf club head according to claim 14, wherein each of the toe structural connector and heel structural connector is a solid rod that is cast into the body.

* * * * *